United States Patent [19]

Bernot

[11] 4,333,275

[45] * Jun. 8, 1982

[54] PROCESS AND APPARATUS FOR DESCALING ROD

[75] Inventor: Jean Bernot, Saint Dizier, France

[73] Assignee: Trefilunion S.A., Saint Dizier, France

[ * ] Notice: The portion of the term of this patent subsequent to Nov. 27, 1996, has been disclaimed.

[21] Appl. No.: 48,114

[22] Filed: Jun. 13, 1979

[30] Foreign Application Priority Data

Jun. 20, 1978 [FR] France ..... 78 18654

[51] Int. Cl.[3] ..... B24C 1/00; B24C 3/12

[52] U.S. Cl. ..... 51/320; 51/321; 51/324; 51/425; 72/40

[58] Field of Search ..... 51/319–321, 51/424, 425, 426, 324, 5 A; 72/40

[56] References Cited

U.S. PATENT DOCUMENTS

| | | | |
|---|---|---|---|
| 2,261,947 | 11/1941 | Barnebl | 51/425 X |
| 3,455,062 | 7/1969 | Eppler | 51/425 |
| 3,628,295 | 12/1971 | Curtis | 51/319 |
| 4,175,412 | 11/1979 | Bernot | 51/320 |

FOREIGN PATENT DOCUMENTS

| | | | |
|---|---|---|---|
| 1234680 | 6/1971 | United Kingdom | 51/425 |
| 1441041 | 6/1976 | United Kingdom | 51/426 |
| 1474374 | 5/1977 | United Kingdom | 51/425 |
| 498999 | 4/1976 | U.S.S.R. | 72/40 |

*Primary Examiner*—Nicholas P. Godici
*Attorney, Agent, or Firm*—Sughrue, Mion, Zinn, Macpeak and Seas

[57] ABSTRACT

Descaling apparatus for steel rod wherein the rod is first bent by two sets of rollers oriented perpendicular to each other to initially dislodge the scale from the surface of the rod. The scale is collected in a hopper then conveyed to a tank where it is mixed with and suspended in water. The scale and water mixture is pumped out of the tank then projected against the surface of the wire as it passes through a descaling chamber by a series of nozzles staggered angularly and longitudinally through the chamber. The mixture following the descaling operation is collected and conveyed to a hydrocyclone and separator which recycles the larger scale particles and water while disposing of the finer scale particles which are too small for use in the descaling operation.

16 Claims, 1 Drawing Figure

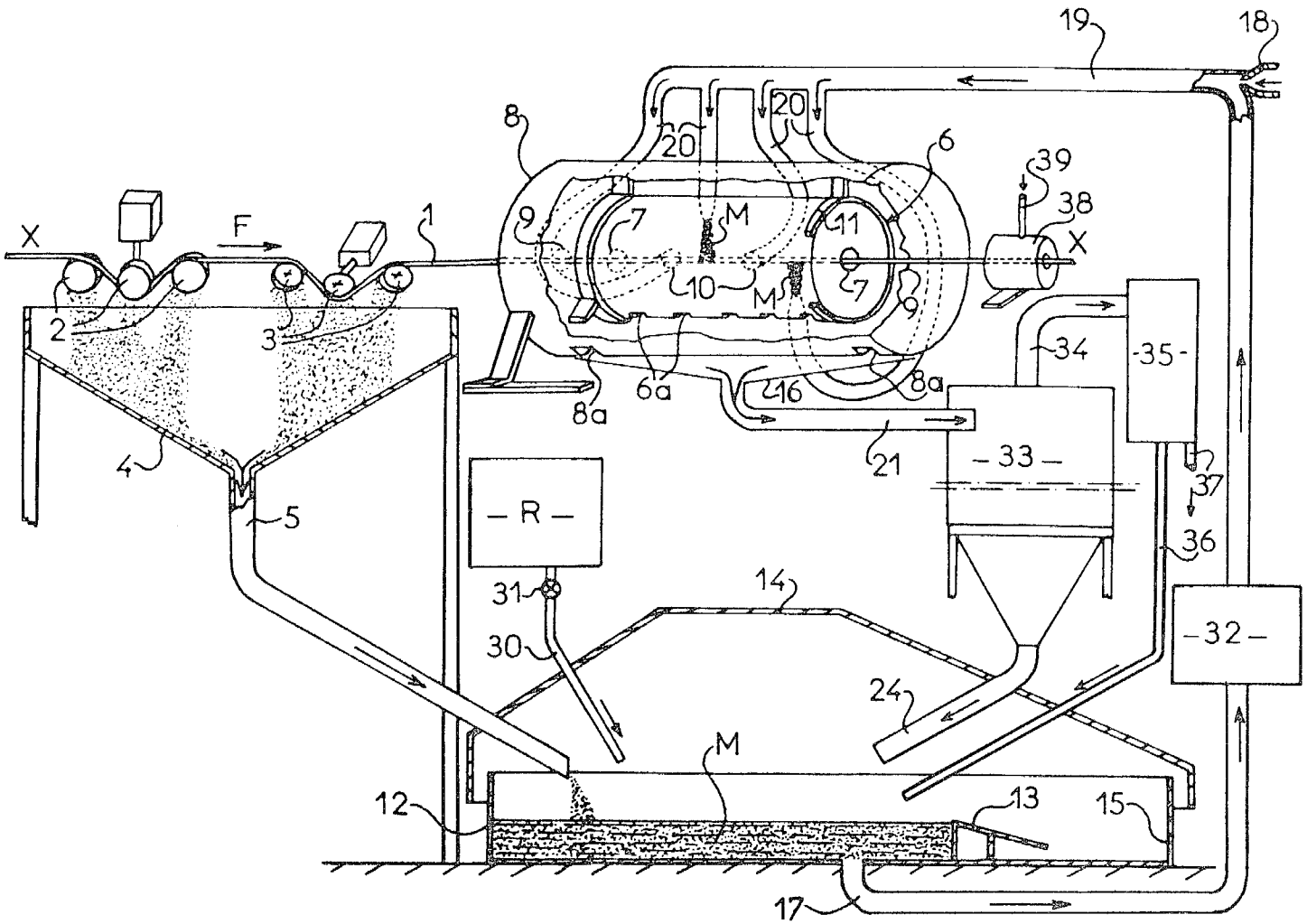
18
19
39
38
X
6
9
8a
11
7
20
M
10
6a
8
1
F
3
2
X
5
4
-35-
37
36
-32-
34
-33-
21
16
14
24
13
15
17
M
12
-R-
31
30

PROCESS AND APPARATUS FOR DESCALING ROD

BACKGROUND OF THE INVENTION

The present invention relates to descaling steel rod so as to obtain a "white" rod, that is a rod having a silky metallic external appearance and which is adapted for drawing.

The descaling is performed on a rod after hot rolling and before drawing through a die.

A process for descaling is known in which scale is recovered by a mechanical device which subjects a rod to multiple bending which loosens the scale from the surface of the rod. The scale is collected in a bin then used for descaling the rod by projection. In accordance with such a prior art process a circuit for recycling the scale is provided, the circuit including a device for sorting particles so as to obtain a quantity of scale which is sufficient for totally descaling the rod being treated.

In this process, the scale, which is dried and propelled simply by jet of air, is broken into smaller particles and, during recycling, it is necessary to eliminate from the circuit particles for use in descaling by projection against the rod.

SUMMARY OF THE INVENTION

The applicant has ascertained that it is possible to limit the tendency to break by operating not with scale consisting of dry particles but instead by using a suspension of scale in water.

To this effect, an object of the invention is to provide a process for descaling metal rod of the type in which the rod is first made to undergo bendings while providing for collection of the scale thereby dislodged and in which this scale is projected in the interior of an enclosure through which the rod passes, the scale being projected several times by recycling, the process being characterized in that the scale is used and projected in a water suspension.

The applicant has ascertained that this improvement does indeed augment the efficiency of the descaling process.

With the process of the invention, recycling of scale is maintained with the scale held in suspension in water. In the recycling circuit, a circulating pump is provided.

According to another characteristice of the invention, sorting of the scale in suspension in water is carried out by means of a hydrocyclone or a similar apparatus which provides, from one part, a phase which contains large scale particles which are recycled and, from the other part, murky water containing dust of the pulverized scale which may be expelled after the water is extracted which may in turn be recycled.

The invention relates as well to apparatus for carrying out the above-described process.

The apparatus of the invention requires more space than that used by the dry process. However, it does provide improved results especially in regard to the appearance obtained of the descaled rod upon being dried by an annular drying device fed with air known as an "air wiper".

Other characteristics and advantages of the invention will become clear from the description which follows.

BRIEF DESCRIPTION OF THE DRAWINGS

The single drawing FIGURE shows a partially cutaway and partially cross-sectional view of apparatus in accordance with the invention.

DESCRIPTION OF THE PREFERRED EMBODIMENTS

As shown in the exemplary embodiment in the single FIGURE, the apparatus of the invention is intended for treating a rod 1 issuing from a spool of rod, not shown, which moves continuously along the path X—X in the direction of arrow F.

The invention includes:

- a bending device
- a cleaning or stripping device which operates by projection of scale suspended in water
- a circuit for recycling the scale suspended in water
- in the recycling circuit, a device for separating the suspension of scale according to the size of the scale particle and for recycling the part containing the larger particles as well as the water from which the finer scale particles have been removed.

As used herein the term "projection of scale" or "scale projection" implies not only projection of scale by itself but includes projection of the water in which the scale is suspended.

The bending device includes a first set of three rollers 2, for example in a vertical plane, and a second set of three rollers, for example in a horizontal plane. The orientation of the plane of first set of rollers is not of significance. However, the plane of the second set should in all cases be orthogonal to the first.

Under sets of rollers 2 and 3 there is disposed a hopper 4 which serves as a receptacle for collecting the scale which is constituted at this state of the apparatus by dry particles of variable size. A conduit 5 extends downwardly from hopper 4.

The device for cleaning or scale projection includes a scale projection chamber 6 having axial inlet and outlet apertures 7 for the passage of the rod 1 in the direction of arrow F. Chamber 6 has a generally cylindrical shape around axis X—X. Its walls are preferably formed of an abrasion resitant flexible material such as urethane rubber. Chamber 6 includes apertures *6a* at its lower part. Descaling chamber 6 is held in place by rigid clamps 11 braced to the interior of protective outer casing 8 which is also cylindrical about axis X—X. Protective outer casing 8 is made of a rigid material It is also provided with axial inlet and outlet apertures 9 for rod 1. Axial apertures 7 and 9 include guide rings or sleeves which for clarity of illustration have not been shown. Casing 8 has radial as well as longitudinal dimensions somewhat greater than the corresponding dimensions of descaling chamber 6 so as to provide with chamber 6 a large annular space. Casing 8 may be formed of steel with a resilient interior lining.

Casing 8 serves equally for the recovery and recycling of mixture M which performs the descaling of the rod by projection thereof and which constitutes a suspension of scale in water. For the recovery of mixture M, casing 8 includes in its cylindrical wall recycling apertures along the length of its lower generatrice. Nozzles 10 for the projection of mixture M against the rod pass through casing 8 and debouch at the inside of descaling chamber 6. Nozzles 10 are disposed with an angular staggering in regard to one another along the cylindrical periphery of chamber 6 and also with a longitudinal staggering with regard to rod 1.

The circuit for recycling mixture M of scale and water includes a storage tank 12 for the dry scale coming from hopper 4. This scale is mixed with water provided from a reservoir R furnished with a conduit 30 debouching into the interior of tank 12. Conduit 30 is provided with valve 31. Tank 12 is connected with auxiliary tank 15 by an adjustable overflow 13 and is covered by a cover or hood 14 which covers the assembly of the two tanks 12 and 15.

To feed nozzles 10 with a mixture of scale suspended in water, a conduit 17 runs from the lower part of tank 12 holding mixture M and rises towards descaling device 6–8. In this part, conduit 17 passes through a pump 32 for circulating mixture M. In conduit 17, in the vicinity of descaling device 6–8, there debouches an air injector 18 with a Venturi pipe. Injector 18 is connected upstream to a source of compressed air at a pressure on the order of 4 to 7 bars and preferably 4 to 5 bars. Conduit 17 is extended at the upper part of the apparatus by a horizontal conduit 19 which is coaxial with the venturi pipe of injector 18 and which debouches into conduit 19. Conduit 19 is divided into branches 20 each connected directly to one of nozzles 10 for projecting mixture M of scale and water, nozzles 10 being, for example, four in number.

For the return or recycling of mixture M of scale and water, a receptacle 16 is positioned just below casing 8 and particularly below apertures 8*a*. A return conduit 21 extends from container 16 which conveys mixture M of scale and water to a hydrocyclone 33, the mixture being recovered in container 16 after having been projected by nozzles 10 against rod 1.

The apparatus for sorting particles of scale in suspension in mixture M includes a hydrocyclone 33, furnished with conduit 21, which separates the mixture into two phases. A first phase in which the scale particles are the largest, is conveyed by a chute 24 to tank 12 and is thus recycled. The other phase of mixture M leaves hydrocyclone 33 at its upper part by means of a conduit 34 and is injected into a separator 35 which extracts the water which is recycled to tank 12 by means of a conduit 36 while the finest scale particles, which form a residue, are removed from the apparatus by means of a conduit 37. Separator 35 may be a filter, a separator or a simple decanting device.

The operation of the apparatus will now be described.

With the use of this apparatus, the process of the invention is implemented in the following manner. As known, rod 1 moves at a certain speed V in the direction of arrow F along axis X—X. Unscaled rod 1 undergoes bendings while passing the two sets of successive rollers 2 and 3 which break the layer of scales and make the rod lose a part of its scale which is collected in receptacle or hopper 4 from which it is conveyed by means of a chute 5 into tank 12. During the start-up phase of the apparatus, valve 31 is placed in the open position so as to fill tank 12 with water from reservoir R up to the level of overflow 13. Tank 12 thus contains a mixture M of scale from hopper 4 and water, this mixture forming a suspension of scale in water in which the scale particles may have a variable size.

Mixture M thus constituted and driven by means of circulating pump 32 is conveyed towards nozzles 10, the mixture M having been propelled at the beginning of part 19 of conduit 17 by a jet of air provided by nozzle 18. Nozzles 10 thus project against rod 1 at the inside of descaling chamber 6, the jets of scale and water having their kinetic energy augmented by the addition of jets of air from nozzles 18. By this action, rod 1 is completely stripped of scale which can still be recovered despite its passage by sets of rollers 2 and 3 to thus become a "white" rod ready for a drawing operation.

Rod 1 emerges from casing 8 and is dried by means of an annular chamber 8 fed with air by conduit 39. Mixture M, which has been projected by nozzles 10 against rod 1, leaves descaling chamber 6 by apertures 6*a* being collected in the inside of casing 8 from which it is removed through apertures 8*a*. The mixture is led by return conduit 21 towards hydrocyclone 33. At this point, a certain number of scale particles have been broken during their projection against rod 1 and the mixture M contains water, large scale particles and finer scale particles. Mixture M is introduced into hydrocyclone 33 which separates it into two phases. A first phase, made up of water and the largest scale particles, is emptied by chute 24 towards tank 12 and is thus recycled while another part, made up of water and much finer scale particles, is emptied by upper conduit 34 towards separator device 35. At the point of separator 35, the mixture of fine scale particles and water is divided into water which is recycled by means of conduit 36 which pours it into tank 12 and a residue made up of the fine scale particles which is removed outside the apparatus by conduit 37. Thus, by means of conduits 36 and 24, tank 12 is replenished and mixture M, stripped of the finest scale particles, is recycled. If it should prove necessary, the water in tank 12 may be adjusted by means of reservoir R and conduit 30. Mixture M of scale and water has thus not only been recycled but also has been in some sense purified. In effect, due to the hydrocyclone which separates from mixture M coming from descaling chamber 6 a phase containing the largest scale particles and a phase containing the finest scale particles, the first phase containing the largest scale particles is recycled directly. With regard to second phase, it is, due to separator 35, also separated out and the water therefrom recycled thus minimizing the consumption thereof so that it is only occasionally necessary to replenish tank 12 from reservoir R. Conduit 37, which extends from separator 35, permits the elimination of the undesirable part of mixture M of scale and water, that is to say that part which is made up of the very fine scale particles which would have only an extremely limited abrasive action if projected against rod 1.

Due to nozzle 18 injecting into the mixture of scale and water conveyed by conduit 19 air of a pressure of approximately 5 bars, the jet is accelerated to the outlet, its kinetic energy increased and the efficiency of the descaling operation within the inside of chamber 6 augmented.

The fact that the rod leaves casing 8 wet does not constitute any inconvenience as it may be very readily and efficaciously dried by means of annular chamber 38 by which the rod is submitted to jets of air.

The descaling operation of the invention provides a white and silky rod, that is one perfectly stripped of the layer of scale which it had carried.

The fact that the scale upon its arrival at tank 12 is suspended in water totally eliminates the creation of dust during the operation of the apparatus.

Utilization of a mixture M of scale suspended in water provides above all reduction of crumbling of scale particles as they strike the rod during descaling; thus removal by conduit 37 of the finest parts of the scale is reduced in quantity.

According to the invention, not only is the scale which forms the mixture suspended in water but, further, its tendency to break and the recycling is made more efficient.

Several variations of the invention are anticipated:

In place of having a chamber 6 with a distinct and separate casing 8 separated by an annular space, a cylindrical steel envelope 8 having an internal resilient coating may be used. Nozzles 10 would then debouch directly into the cavity of casing 8 separated by an annular space. A cylindrical steel envelope 8 having an internal resilient coating may be used. Nozzle 10 would then debouch directly into the cavity of casing 8 which then itself becomes the descaling chamber. The function and the advantage of this variation are themselves the same as those described above.

In place of having a single conduit 17 for conveying mixture M from tank 12 for the entire group of nozzles 10, a single such conduit may be provided for each one of the nozzles. In this case, it will be necessary of course to provide each conduit with a circulating pump such as pump 32 and an air injection nozzle such as nozzle 18. Thus, nozzles 10 and their feeding circuit are independent and each one of them may be operated without disturbing the operation of the others.

It is also possible for mixture M to use liquids other than water or to use water with an addivive so as to provide, for example, a protective film on the rod.

Another variation resides in the recovering water expelled from separator 35 by conduit 36 not as in the example given wherein mixture M is deposited in tank 12 but wherein it is projected directly on rollers 2 and 3 positioned at the entry to the descaling apparatus. Formation of dust is therefor entirely eliminated as the scale recovered in hopper 4 is wet. Mixture M of scale and water which is collected in tank 12 is also made up at this point. This variation provides for the descaling of a wet rod and is thus unnecessary then to dry the incoming rod coming from the rod supply prior to its introduction into the mechanical descaling device at sets of rollers 2 and 3.

What is claimed is:

1. A process for removing iron oxide scale from a steel rod, including the steps of bending the rod to cause a portion of said scale to be detached from the rod surface, collecting the detached scale, projecting the collected scale against the rod within an enclosure at a point downstream from the bending site, re-collecting the projected and newly detached scale, and recycling the re-collected scale for further projecting, characterized by:

(a) suspending the collected, projected, re-collected and recycled scale in a liquid carrier, (b) accelerating the projected suspended scale against the rod with pressurized air, (c) projecting the accelerated suspended scale against the rod at a plurality of axially spaced points relative to the longitudinal dimension of the rod, and (d) elastically cushioning the interior surface of the enclosure.

2. A process as defined in claim 1, further characterized by alternately bending the rod back and forth in two mutually orthogonal planes.

3. The process of descaling of claim 2 wherein the liquid in which the scale is suspended is water.

4. The process according to either of claims 2 or 3 further comprising, prior to recycling, separating the suspended scale into two phases by a hydrocyclone, recycling directly a phase containing larger scale particles, recycling water contained in the other phase containing smaller scale particles, and eliminating the smaller scale particles as a residue.

5. The process of either of claims 2 or 3 wherein the liquid is recycled to an overflow tank containing the mixture of scale and water.

6. The process of either of claims 2 or 3 wherein the liquid is recycled by projection against rollers of a bending apparatus disposed at the entry of the apparatus.

7. An apparatus for removing iron oxide scale from a steel rod, including means for bending the rod to cause a portion of said scale to be detached from the rod surface, means for collecting the detached scale, means for projecting the collected scale against the rod within an enclosure at a point downstream from the bending site, means for re-collecting the projected and newly detached scale, and means for recycling the re-collected scale for further projecting, characterized by:

(a) a tank containing a suspension of the collected, projected, re-collected and recycled scale in water, (b) a pressurized air nozzle opening into conduit means for the suspended scale for accelerating it against the rod, (c) a plurality of axially spaced nozzles relative to the longitudinal dimension of the rod for projecting the accelerated suspended scale thereagainst, and (d) elastically deformable cushioning means lining the interior surface of the enclosure.

8. The apparatus of claim 7 wherein the mixture of scale suspended in water is conveyed from the tank to the nozzles by a conduit including therein a circulation pump.

9. The apparatus of claim 8 wherein the enclosure has an exterior casing having apertures above a receptacle for recovering the mixture of scale and water after the mixture has been projected against the rod.

10. The apparatus of claim 9 wherein the receptacle conveys the mixture to a hydrocyclone which separates it into two phases, the first phase containing water and larger particles of scale being recycled directly by conveyance to the tank by means of a first conduit, the second phase being conveyed to a separator for extracting water which is recycled, and the separator having a chute for expelling finer scale particles outside the apparatus.

11. The apparatus of claim 10 wherein the water from the separator is recycled by conveying it by a second conduit to the tank containing the mixture of scale and water.

12. The apparatus of claim 10 wherein the water from the separator is recycled by projection on rollers of the bending means disposed at the entry of the apparatus.

13. The apparatus of any of claims 10 to 12 wherein the separator comprises a filter.

14. The apparatus of any of claims 8 to 12 wherein the tank comprises an overflow reservoir.

15. The apparatus of any of claims 10 to 12 wherein the separator comprises a centrifuge.

16. The apparatus of any of claims 8 to 12 wherein the rod passes through a drying chamber fed with compressed air at the exit from the enclosure.

* * * * *